US008960477B1

(12) United States Patent
Bishop

(10) Patent No.: US 8,960,477 B1
(45) Date of Patent: Feb. 24, 2015

(54) HOLDER ATTACHABLE TO A BOAT

(71) Applicant: Jerry W. Bishop, Destin, FL (US)

(72) Inventor: Jerry W. Bishop, Destin, FL (US)

( * ) Notice: Subject to any disclaimer, the term of this patent is extended or adjusted under 35 U.S.C. 154(b) by 28 days.

(21) Appl. No.: 13/763,677

(22) Filed: Feb. 10, 2013

(51) Int. Cl.
*B65D 25/24* (2006.01)
*B63B 17/00* (2006.01)

(52) U.S. Cl.
CPC ..... *B63B 17/00* (2013.01)
USPC ..... 220/476; 220/481; 224/579; 224/585

(58) Field of Classification Search
USPC ..... 248/311.2, 313, 304, 339; 224/578, 224/579, 580, 584, 585, 269, 406, 565, 564, 224/566; 220/476, 480, 481, 485; 114/345; 211/88.01, 90.03, 106, 119, 119.006, 211/119.007
See application file for complete search history.

(56) References Cited

U.S. PATENT DOCUMENTS 6,607,088 B2 * 8/2003 Cestrone ..... 220/23.86
7,506,758 B2 * 3/2009 Davis-Garrison ..... 206/320
7,739,964 B2 * 6/2010 Hatton ..... 108/47

FOREIGN PATENT DOCUMENTS

JP 2002029472 A * 1/2002 ..... B62J 9/00

* cited by examiner

*Primary Examiner* — Alfred J Wujciak
(74) *Attorney, Agent, or Firm* — Peter Loffler

(57) ABSTRACT

A holding device is attachable to a rail, cleat, etc., of a boat or other object such that the holding device holds a cooler or similar objects without using up passenger space. The holding device has a frame with extension arms, the main body of the frame attached to the boat either via passing an appropriate upright (cleat, post, etc.,) through an appropriate opening on the frame or using straps passing through slits on the frame. A basket is attached to the frame for holding loads therein. A board is removably attached to frame for use as a working surface or even a basketball backboard.

20 Claims, 5 Drawing Sheets

HOLDER ATTACHABLE TO A BOAT

This application is a Continuation-In-Part of U.S. patent application Ser. No. 12/803,949, filed on Jul. 12, 2010, which application is incorporated by reference herein in its entirety.

BACKGROUND OF THE INVENTION

1. Field of the Invention

The present invention relates to a holder for ice chests and similar devices wherein the holder overhangs the side of a boat in order to save space on the boat.

2. Background of the Prior Art

Boating is a popular pastime enjoyed by many, especially considering the fact that most Americans live a short driving distance from a navigable body of water. When the weather is agreeable, just load up the boat with fishing gear or other toys, food, drinks, and other whatnots, and then launch the boat for a fun filled day on the water. Although reasonable in size for their intended purpose, most boats, nevertheless, tend to be relatively small in size. Many factors dictate the need to keep boats relatively small including the costs of the boat, the high fuel consumption of a boat, the need to be able to tow the boat to the launch site, and the need to store the boat, among others. While even a small boat can be quite fun and relaxing, certain tradeoffs must be made. With several people on board a relatively small boat, precious little real estate, both deck space and seating space, remains for other items such as bait holders, coolers, picnic baskets, etc, items which are considered essential for all but the shortest of boat rides. Placing such items onto the boat crowds the deck and makes it more difficult for the passengers to move around. While many boats have below deck storage areas, such storage areas are often difficult to access and require the passengers to crowd to one section of the boat, which can be quite uncomfortable, especially when the outside temperatures are very hot.

What is needed is a device that allows boat captains to be able to take coolers and other items aboard a boat without sacrificing the relatively scarce deck space and seating areas aboard the boat. Such a device must allow quick and easy access to the items being held by the device without imposing an undue burden upon the boat's passengers. Ideally such a device should be of relatively simple design and construction and be easy to install, operate, and maintain.

SUMMARY OF THE INVENTION

The holder attachable to a boat of the present invention addresses the aforementioned needs in the art by providing a holder that is capable of holding typical coolers as well as various other items on board a boat without the need to take up any deck or seating real estate of the boat. The holder attachable to a boat allows for quick and easy access to the items being held therein without the need to herd the passengers to a particular section of the boat. The holder attachable to a boat is of relatively simple design and construction so as to be relatively inexpensive to manufacture making the device economically affordable to a large portion of the boat owning consumers. The holder attachable to a boat is relatively easy to install upon the boat, is easy to operate, and to maintain.

The holder attachable to a boat of the present invention is comprised of a frame member that has a horizontal plate that has a first outer surface and a first inner surface and at least one first opening (slit, J-channel opening, cleat opening, etc.,). The frame member also has a vertical plate that has a second outer surface and a second inner surface and at least one slit. The horizontal plate and vertical plate are attached to each other at an angle (preferably but not necessarily an approximate right angle). The frame member also has a first extension arm extending outwardly from the second outer surface of the vertical plate and a second extension arm extending outwardly from the second outer surface of the vertical plate and coextensive with the first extension arm. A basket has a top rail having a pair of longitudinal legs connected by a pair of latitudinal legs. At least one first strap is attached to each of the two latitudinal legs and to the first extension and to the second extension. At least one second strap is attached to the two longitudinal legs and passes through the slit and then the second strap attaches back to itself in order to secure the basket to the vertical plate.

The first strap has a first loop on a first end thereof such that the first loop encircles the first extension arm and the first strap has a second loop on an opposing second end thereof such that the second loop encircles the second extension arm. The first extension arm has a first upwardly turned lip on a first distal end thereof and the second extension arm has a second outer lip on a second distal end thereof. A board member has a first notch defining a first leg and a second notch defining a second leg with the first notch and the second notch located along an edge thereof. The board member is placed onto the first extension arm and the second extension arm such that the first notch receives the first lip and the second notch receives the second lip. The first extension arm has a third notch and the second extension arm has a fourth notch such that the board member is placed onto the first extension arm and the second extension arm such that the first notch and the third notch receive each other and the second notch and the fourth notch receive each other. The horizontal plate has a second opening and a third opening such that the board member is placed onto horizontal plate and such that the second opening receives the first leg and the third opening receives the second leg. A non-scuff material is located on the first inner surface and the second inner surface.

BRIEF DESCRIPTION OF THE DRAWINGS

Similar reference numerals refer to similar parts throughout the several views of the drawings.

DESCRIPTION OF THE PREFERRED EMBODIMENT

Figure 1:
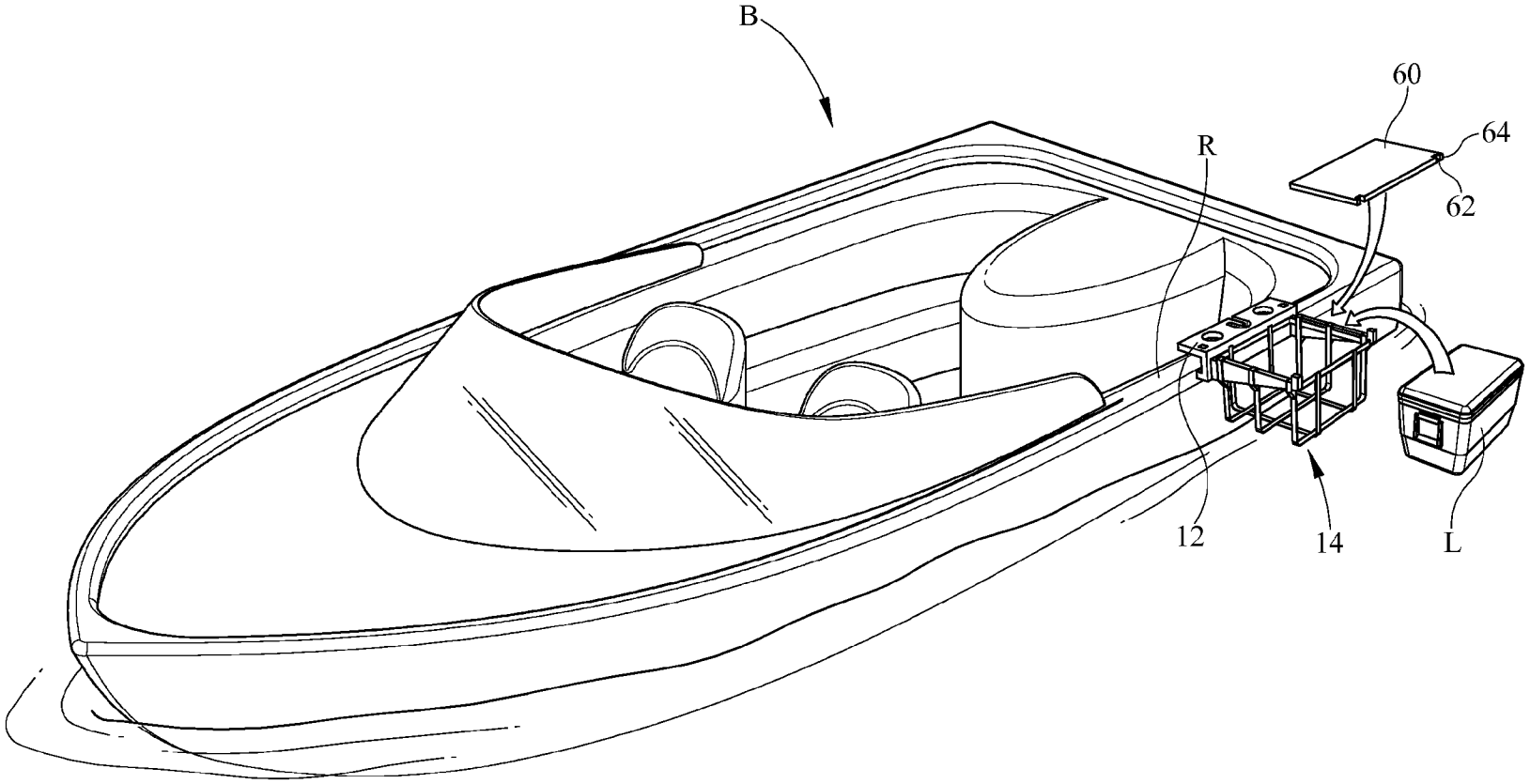
FIG. 1 is a perspective environmental view of the holder attachable to a boat of the present invention.
Figure 2:
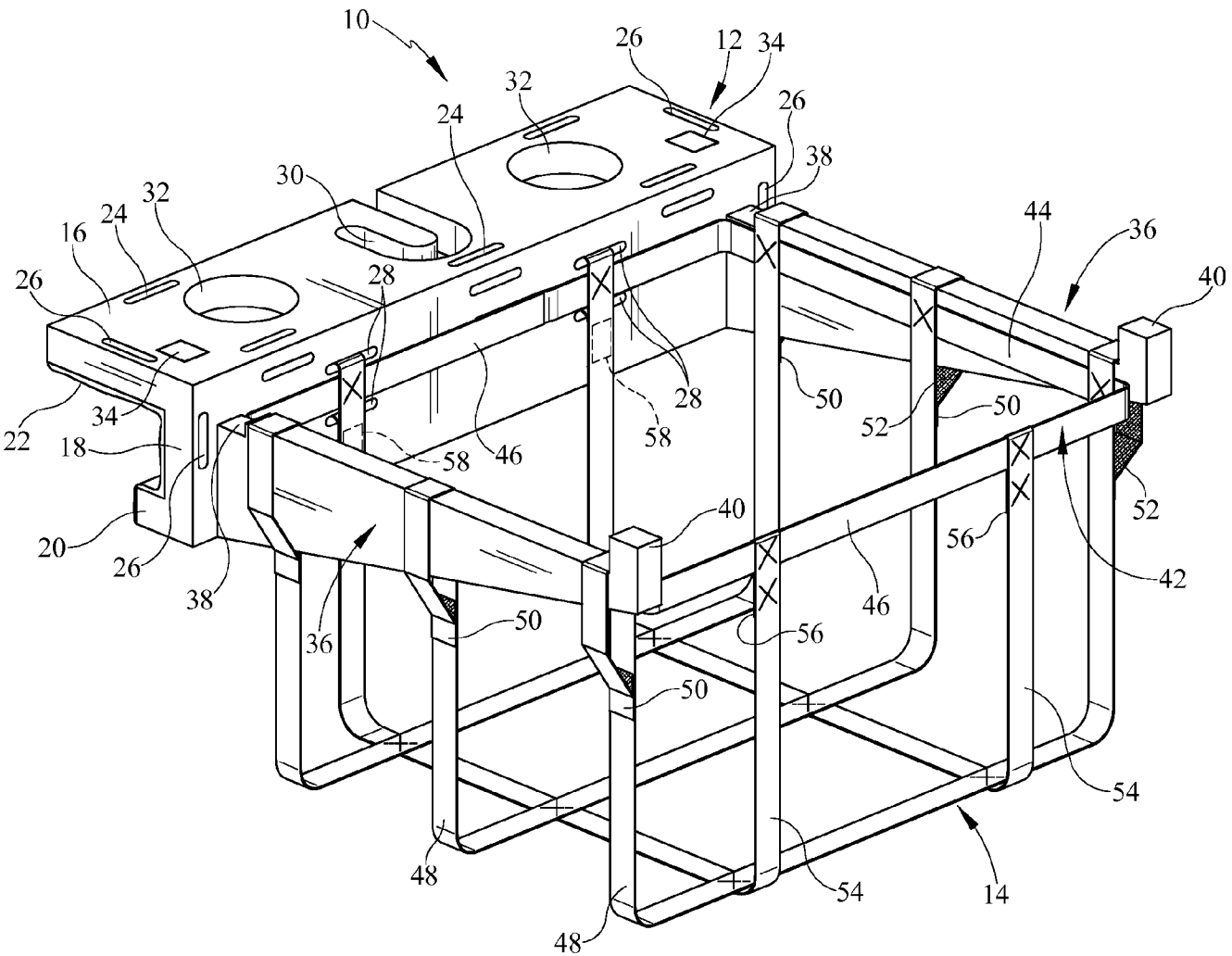
FIG. 2 is a perspective view of the holder attachable to a boat.
Figure 3:
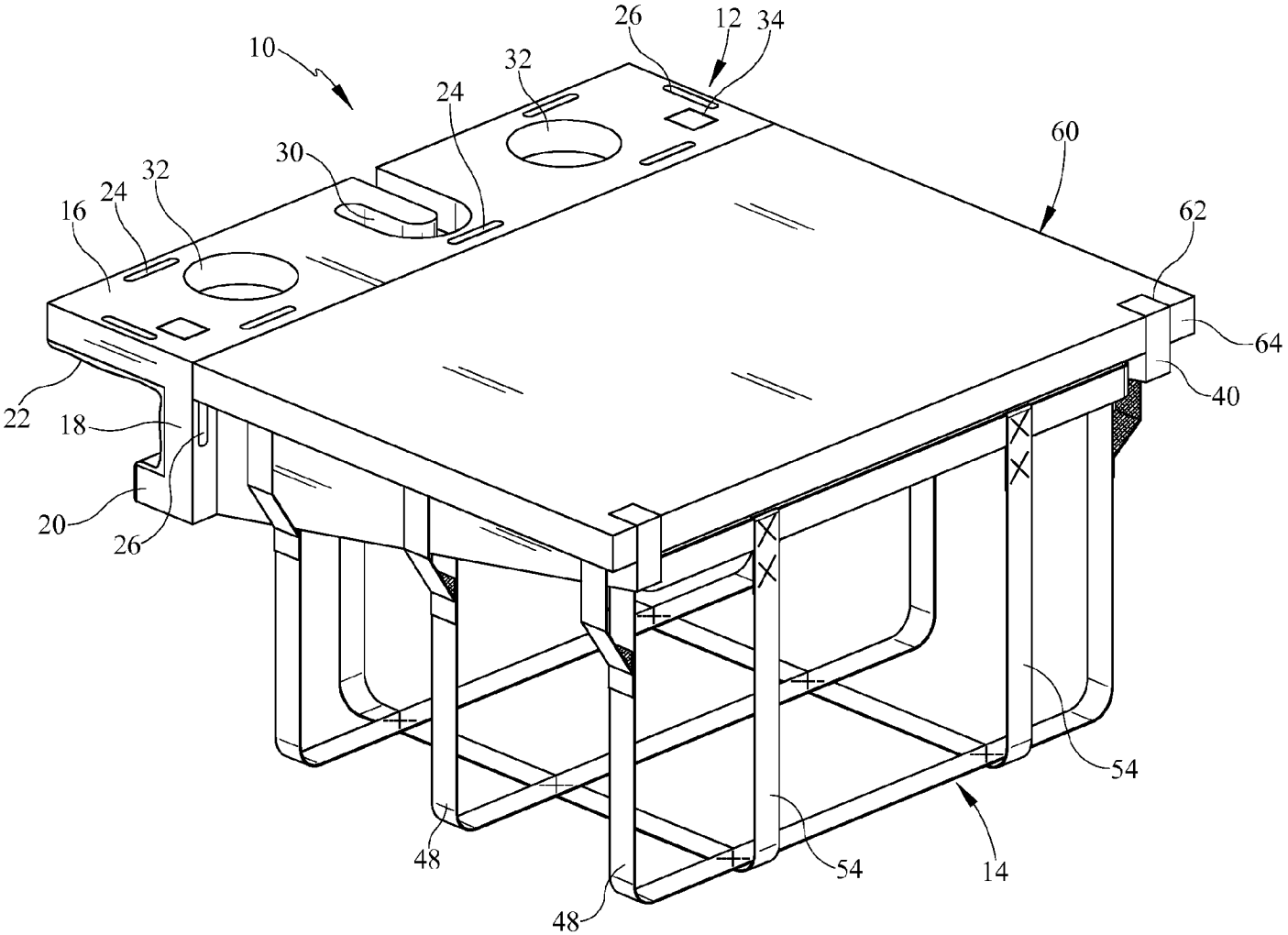
FIG. 3 is a perspective view of the holder attachable to a boat with the board member laying horizontal across the extension arms.
Figure 4:
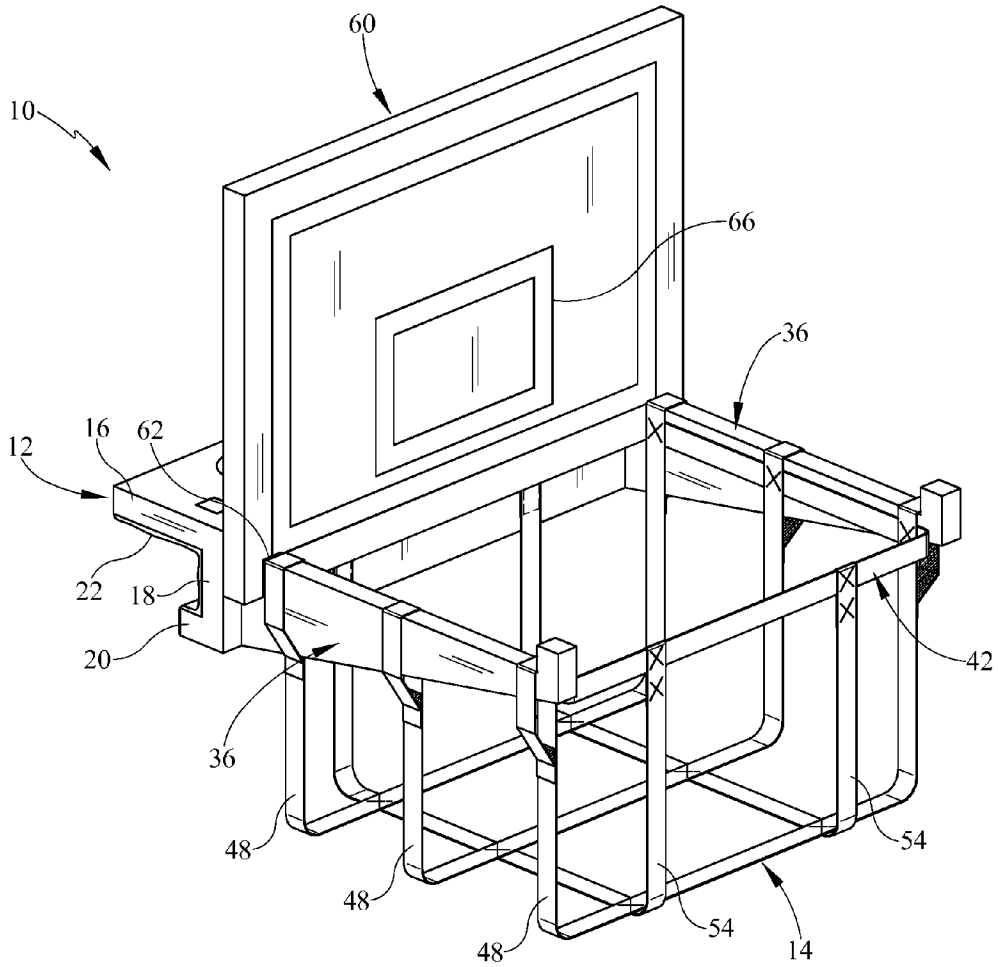
FIG. 4 a perspective view of the holder attachable to a boat with the board member vertically attached to the extension arms.
Figure 5:
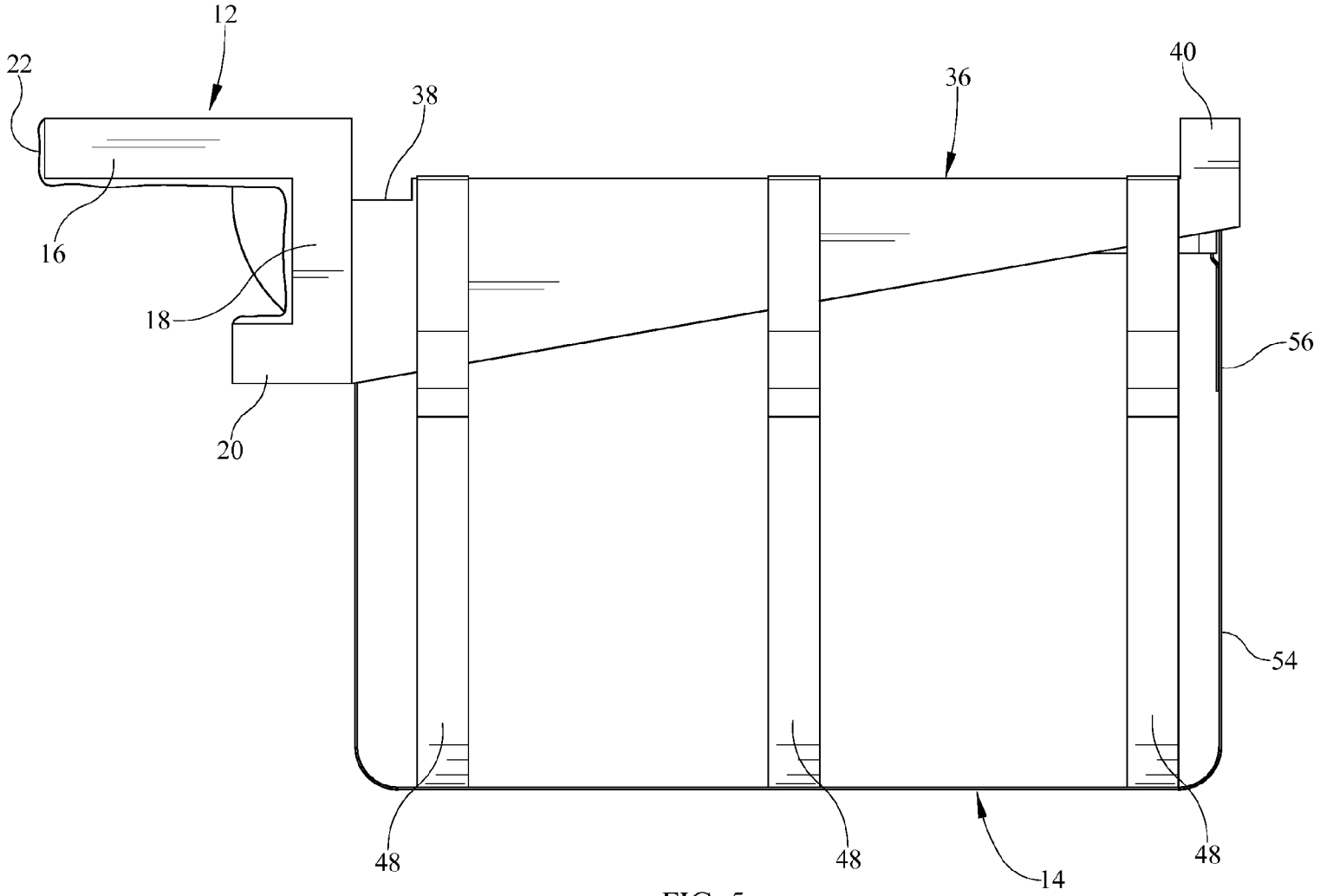
FIG. 5 is a side view of the holder attachable to a boat.

Referring now to the drawings, it is seen that the holder attachable to a boat of the present invention, generally denoted by reference numeral 10, is comprised of a frame member 12 and a basket 14.

As seen, the frame member 12 comprises a horizontal plate 16 and a vertical plate 18 joined together at an approximate right angle. The vertical plate 18 may have a lip 20 running along its lower edge. A portion of the frame 12 including the inner surface of the horizontal plate 14, the vertical plate 18, and the lip 20, as well as the outer edge of the horizontal plate 16 and the lip 20 may have an appropriate non-scuff material layer 22 (such as foam, rubber, neoprene, etc.,) thereon, in order to protect the surface of the boat B to which the frame 12 is attached. As seen, a set of first slits 24 is located on the frame member 12, each set of first slits 24 comprising two or more individual aligned slits 24 that can be located on the horizontal plate 16, the vertical plate 18, or a combination thereof. Additional sets of first slits 24 can also be provided. As further seen, one or more second slits 26 are located on either end of the frame 12, again on the horizontal plate 16, the vertical plate 18 or both. Each second slit 26 is transverse relative to the first slits 24 and is aligned with a corresponding second slit 26 located on the opposing end of the frame member 12. A set of third slits 28 is located on the frame member 12, each set of third slits 28 being an aligned pair of slits 28 (although a single third slit 28 could prove satisfactory) advantageously located on the vertical plate 18 (although one of the pair of third slits 28 may be located on the horizontal plate 16). Additional sets of third slits 28 are provided, the number of sets being dependent on the length of the frame 12.

A further seen, various openings may be located on the horizontal plate 16. A J-channel opening 30 may be located on the horizontal plate 16, as may be a pair of round or other shaped relatively large cleat openings 32, as may be a pair of generally rectangular shaped board openings 34, such board openings 34 being located proximate the ends of the frame member 12 and proximate the vertical plate 18.

The frame member 12 has a pair of extension arms 36, each extension arm 36 extending outwardly from the vertical plate 18 in spaced apart fashion. Each extension arm 36 has a notch 38 located at the arm's attachment point with the vertical plate 18. A small lip 40 extends upwardly from each extension arm 36 at the arm's distal end.

The frame 12 and its extension arms 36 are each made from an appropriate sturdy material such as aluminum, plastic, etc., the choice of material taking into account the fact that the holder attachable to a boat 10 is used in a water environment, possibly a salt water environment. The frame member 12 itself may be of monolithic construction for ease of manufacturing and assembly of the overall holder attachable to a boat 10, although such is not a requirement. Additionally, the frame member 12 and its extension arms 36 may also be of monolithic construction, although for ease of manufacture and storage of the holder attachable to a boat 10 when not in use, the extension arms 36 may be separate from the frame member 12 and attached to the vertical plate 18 of the frame member 12 in any appropriate manner well known in the art.

As seen, the basket 14 is generally rectangular in shape and has a top rail 42 that has a pair of latitudinal legs 44 joined by a pair of longitudinal legs 46. A series of first generally U-shaped first straps 48 each have a pair of first ends 50 such that each first end 50 is attached to a respective one of the latitudinal legs 44. The first ends 50 of each first strap 48 can be attached to their respective latitudinal leg 44 in any appropriate manner including direct attachment of the first end 50 to the latitudinal leg 44, via stitching, adhesion, etc., by forming a loop at the first end 50 and looping about the latitudinal leg 44 and attaching the first end 50 back to the first strap 48 and securing thereto, again via stitching, adhesion, etc. However, preferably, the first strap 48 is attached the latitudinal leg 44 (stitching, adhesion, etc.,) and also has first sections of cooperating hook and loop material 52 on an inner facing surface allowing the first end 50 to loop back onto the first strap 48 and removably attach thereto to form a closed loop.

A series of second generally U-shaped second straps 54 each have a pair of second ends 56 such that each second end 56 is attached to a respective one of the longitudinal legs 46. The second ends 56 of each second strap 54 can be attached to their respective longitudinal leg 46 in any appropriate manner including direct attachment of the second end 56 to the longitudinal leg 46, via stitching, adhesion, etc., by forming a loop at the second end 56 and looping about the longitudinal leg 46 and attaching the second end 56 back to the second strap 54 and securing thereto, again via stitching, etc. However, preferably, for the longitudinal leg that is positioned proximate the frame member 12, the second strap is attached to this longitudinal leg 46 in appropriate fashion (stitching, adhesion, etc.,) and also has second sections of cooperating hook and loop material 58 on an inner facing surface allowing the second end 56 (located past the attachment point of the second strap 54 with the longitudinal leg 46) to loop back onto the second strap 54 and removably attach thereto to form a closed loop thereby removably securing the basket 14 to the frame member 12.

The top rail 42 and straps 48 and 54 may be made from a rigid material, but are preferably made from a flexible material such as Nylon, etc., (at least the straps 48 and 54) for ease of attachment of the basket 14 to the frame member 12 and for storage purposes.

The first straps 48 can be secured to the second straps 54 at their overlap points in appropriate fashion (stitching, adhesion, etc.).

Netting (not illustrated) can be located within the basket 14 in order to allow relatively small objects to be held by the basket 14.

In order to use the holder attachable to a boat 10 of the present invention, the extension arms 36 are attached to the frame member 12, if necessary, and the frame member 12 is attached to an appropriate area of the boat B or other object. Such attachment can be in one of various manners. Cleats or other uprights such as portable post or holding brackets placed in rod holders (not illustrated) located on the boat B can pass through the J-channel 30 or cleat openings 32. As a further alternate, and possibly the most common attachment method is to use one or more straps to secure the frame 12 to an appropriate portion of the boat B such as the illustrated boat rail R. Each strap passes through a pair of first slits 24, a pair of second slits 26, or a pair of third slits 28 as appropriate, the number of straps being dependent on the size of the frame member 12 and the anticipated load L to be carried by the holder attachable to a boat 10. The straps can be a separate item (not illustrated) or can be the second straps 54 that each pass through a respective one pair of third slits 28, the second straps 54 looping back onto themselves with the second ends 56 being removably secured to the body of the second strap 54 via the second sections of cooperating hook and loop material 58. Thereafter the basket 14 is attached to the frame member 12 (the remainder of the basket 14 is attached to the frame member 12 if the second straps 54 are used to secure the frame member 12 to the boat B) by encircling the first end 50 of each first strap 48 about its respective extension arm 36 and securing the first strap 48 in such looped position via the first sections of cooperating hook and loop material 50. The holder attachable to a boat 10 is now ready for use.

It is expressly recognized that the basket 14 can be attached to the frame member 12 in other methods than described above. The basket 14 can be fixedly attached to the frame member 12 including its extension arms 36 in appropriate fashion such as by adhesion. Alternately, the basket 14 can be removably attached to the frame member 12 by using third sections of cooperating hook and loop material (not illustrated) located on the vertical plate 18 and the extension arms 36 and the corresponding sections located on the top rail 42 and/or the first straps 48 and second straps 54, etc.

As seen, a board member 60 can be provided, the board member 60 being such that at least one and preferably both major surfaces that are flat. The board member 60 may have a pair of spaced apart notches 62 located along one of its longitudinal edges, such notches 62 defining legs 64. The board member 60 may be laid flat on the extension arms 36 so as to provide a working surface (drink holder, cutting board, etc., the board member 60 dimensioned to substantially extend between the vertical plate 18 and the lip 40 on each extension arm 36 with each notch 62 receiving one of the respective lips 40 to help hold the board member 60 in position. Advantageously, although not necessarily, the upper facing surface of the board member 60 is generally flush with the upper surface of the horizontal plate 16. The board member 60 may be positioned vertically such that each notch 38 of the extension arm receives a respective one notch 62 of the board member 60 to so hold the board member 60. As seen, the surface of the board member 60 may have basketball markings 66 thereon for using the holder attachable to a boat 10 as a basketball net. The board member 60 may be dimensioned so that its legs 64 are receivable within the board openings 34 of the horizontal plate 16 as an alternate method of holding the board member 60 in a vertical position. The board member 60 can be made from any appropriate sturdy material, although since it is quite possible that the board member 60 may fall into the water, the use of a buoyant material, such as plastic is preferred.

While the invention has been particularly shown and described with reference to an embodiment thereof, it will be appreciated by those skilled in the art that various changes in form and detail may be made without departing from the spirit and scope of the invention.

I claim:

1. A holding device for hanging a basket, comprising:

a frame member having a horizontal plate, the horizontal plate having a first outer surface and a first inner surface and at least one first opening, the frame member also having a vertical plate, the vertical plate having a second outer surface and a second inner surface, the horizontal plate and vertical plate attached to each other at an angle, the frame member also having a first extension arm extending outwardly from the second outer surface of the vertical plate and a second extension arm extending outwardly from the second outer surface of the vertical plate and coextensive with and spaced apart from the first extension arm;

the basket attached to the second outer surface of the vertical plate, to the first extension arm, and to the second extension arm; and the first extension arm has a first upwardly turned lip on a first distal end thereof and the second extension arm has a second outer lip on a second distal end thereof and such that a board member has a first notch defining a first leg and a second notch defining a second leg, the first notch and the second notch located along an edge thereof, such that the board member is placed onto the first extension arm and the second extension arm such that the first notch receives the first lip and the second notch receives the second lip and the first extension arm has a third notch and the second extension arm has a fourth notch such that the board member is placed onto the first extension arm and the second extension arm such that the first notch and the third notch receive each other and the second notch and the fourth notch receive each other.

2. The holding device as in claim 1 wherein the basket is removably attached to the second outer surface of the vertical plate, to the first extension arm, and to the second extension arm.

3. The holding device as in claim 1 wherein the horizontal plate has a second opening and a third opening such that the board member is placed onto horizontal plate such that the second opening receives the first leg and the third opening receives the second leg.

4. The holding device as in claim 1 wherein the vertical plate has a slit thereon such that a strap of the basket passes through the slit and then the strap attaches back to itself in order to form a closed loop to secure the basket to the vertical plate.

5. The holding device as in claim 1 further comprising a non-scuff material located on the first inner surface and the second inner surface.

6. A holding device for hanging a basket, comprising:

a frame member having a horizontal plate, the horizontal plate having a first outer surface and a first inner surface and at least one first opening, the frame member also having a vertical plate, the vertical plate having a second outer surface and a second inner surface and at least one slit, the horizontal plate and vertical plate attached to each other at an angle, the frame member also having a first extension arm extending outwardly from the second outer surface of the vertical plate and a second extension arm extending outwardly from the second outer surface of the vertical plate and coextensive with and spaced apart from the first extension arm; and the basket having a top rail, the top rail having a pair of longitudinal legs connected by a pair of latitudinal legs such that at least one first strap is attached to each of the two latitudinal legs and to the first extension and to the second extension and such that at least one second strap is attached to the two longitudinal legs and passes through the slit and then the second strap attaches back to itself in order to secure the basket to the vertical plate.

7. The holding device as in claim 6 wherein the first strap has a first loop on a first end thereof such that the first loop encircles the first extension arm, the first strap also having a second loop on an opposing second end thereof, the second loop encircles the second extension arm (original).

8. The holding device as in claim 7 wherein the first extension arm has a first upwardly turned lip on a first distal end thereof and the second extension arm has a second outer lip on a second distal end thereof and such that a board member has a first notch defining a first leg and a second notch defining a second leg, the first notch and the second notch located along an edge thereof, such that the board member is placed onto the first extension arm and the second extension arm such that the first notch receives the first lip and the second notch receives the second lip.

9. The holding device as in claim 8 wherein the first extension arm has a third notch and the second extension arm has a fourth notch such that the board member is placed onto the first extension arm and the second extension arm such that the first notch and the third notch receive each other and the second notch and the fourth notch receive each other.

10. The holding device as in claim 8 wherein the horizontal plate has a second opening and a third opening such that the board member is placed onto horizontal plate such that the second opening receives the first leg and the third opening receives the second leg.

11. The holding device as in claim 8 further comprising a non-scuff material located on the first inner surface and the second inner surface.

12. The holding device as in claim 6 wherein the first extension arm has a first upwardly turned lip on a first distal end thereof and the second extension arm has a second outer lip on a second distal end thereof and such that a board member has a first notch defining a first leg and a second notch defining a second leg, the first notch and the second notch located along an edge thereof, such that the board member is placed onto the first extension arm and the second extension arm such that the first notch receives the first lip and the second notch receives the second lip.

13. The holding device as in claim 6 wherein the first extension arm has a third notch and the second extension arm has a fourth notch such that the board member is placed onto the first extension arm and the second extension arm such that the first notch and the third notch receive each other and the second notch and the fourth notch receive each other.

14. The holding device as in claim 6 wherein the horizontal plate has a second opening and a third opening such that the board member is placed onto horizontal plate such that the second opening receives the first leg and the third opening receives the second leg.

15. The holding device as in claim 6 further comprising a non-scuff material located on the first inner surface and the second inner surface.

16. A holding device for hanging a basket, comprising:

a frame member having a horizontal plate, the horizontal plate having a first outer surface and a first inner surface and at least one first opening, the frame member also having a vertical plate, the vertical plate having a second outer surface and a second inner surface, the horizontal plate and vertical plate attached to each other at an angle, the frame member also having a first extension arm extending outwardly from the second outer surface of the vertical plate and a second extension arm extending outwardly from the second outer surface of the vertical plate and coextensive with and spaced apart from the first extension arm;

the basket attached to the second outer surface of the vertical plate, to the first extension arm, and to the second extension arm; and wherein the vertical plate has a slit thereon such that a strap of the basket passes through the slit and then the strap attaches back to itself in order to form a closed loop to secure the basket to the vertical plate.

17. The holding device as in claim 16 wherein the basket is removably attached to the second outer surface of the vertical plate, to the first extension arm, and to the second extension arm.

18. The holding device as in claim 16 wherein the first extension arm has a first upwardly turned lip on a first distal end thereof and the second extension arm has a second outer lip on a second distal end thereof and such that a board member has a first notch defining a first leg and a second notch defining a second leg, the first notch and the second notch located along an edge thereof, such that the board member is placed onto the first extension arm and the second extension arm such that the first notch receives the first lip and the second notch receives the second lip.

19. The holding device as in claim 18 wherein the horizontal plate has a second opening and a third opening such that the board member is placed onto horizontal plate such that the second opening receives the first leg and the third opening receives the second leg.

20. The holding device as in claim 16 further comprising a non-scuff material located on the first inner surface and the second inner surface.

* * * * *